United States Patent [19]

Shirey et al.

[11] Patent Number: 4,779,394

[45] Date of Patent: Oct. 25, 1988

[54] CONNECTOR FOR SUSPENSION CEILING GRID

[75] Inventors: Richard Shirey, Avon; Gerald L. Koski, Parma; Jonathan P. Teli, Avon Lake; David F. Mieyal, Strongsville, all of Ohio

[73] Assignee: Donn, Incorporated, Chicago, Ill.

[21] Appl. No.: 38,246

[22] Filed: Apr. 14, 1987

[51] Int. Cl.[4] ..... E04C 2/42

[52] U.S. Cl. ..... 52/667; 52/484

[58] Field of Search ..... 52/667, 664, 484; 403/347

[56] References Cited

U.S. PATENT DOCUMENTS

| | | | |
|---|---|---|---|
| 3,367,695 | 2/1968 | Haertel et al. | 52/667 X |
| 3,501,185 | 7/1966 | Brown et al. . | |
| 4,108,563 | 8/1978 | Brown et al. . | |
| 4,317,641 | 3/1982 | Sauer | 52/667 X |
| 4,611,453 | 9/1986 | Worley . | |

*Primary Examiner*—Carl D. Friedman

*Attorney, Agent, or Firm*—Pearne, Gordon, McCoy & Granger

[57] ABSTRACT

A suspension ceiling grid system having grid runners connected at intersections including a through-runner and opposed runner ends connected together and to the through-runner on opposite sides of the through-runner. Each runner end is provided with an end connector which extends through an opening in the web of the through-runner. Each connector is provided with a first-end-in-lock which connects the connector to the through-runner itself and a dual connector-to-connector lock which interconnects the two connectors at the intersection. The first-end-in-lock provides opposed lateral projections which engage the remote side of the web of the through-runner beyond the ends of the opening therein. The connectors may be disassembled from an intersection without the need for tools and without damage to either the connector or the through-runner opening. Further, an intersection can be disassembled and subsequently reassembled in a trapped module condition.

26 Claims, 5 Drawing Sheets

CONNECTOR FOR SUSPENSION CEILING GRID

BACKGROUND OF THE INVENTION

This invention relates generally to suspension ceiling grid systems, and more particularly to a novel and improved grid connector system for interconnecting grid runners.

PRIOR ART

Typical suspension ceiling grid provides interconnected grid runners or tees. Such runners are interconnected to define panel-receiving openings which are usually square or rectangular. The intersections usually provide a through-runner and opposed runners which have end connectors that extend from opposite sides through an opening in the web of the through-runner in an interlocking manner. Some such connectors provide a hook portion which is inserted through the opening in the through-runner and then drops down to engage the remote side of the web below such opening. An example of such connectors is illustrated in U.S. Pat. No. 3,501,185.

Other connectors provide connector-to-connector locking means which directly interlock with the opposing connector. Some connectors which provide a connector-to-connector lock also include a locking structure which interlocks the connector with the remote side of the web of the through-runner. Such locking structure is often referred to as a "first-end-in-lock" because it provides a connection with the web of the through-runner when only one connector is installed in the opening in the through-runner web. This first-end-in-lock therefore provides a connection which functions until the second connector is inserted to complete the intersection. Also, it functions to provide the connection at intersections where only a single runner end is connected to the through-runner.

The locking system which provides a direct interconnection between the two connectors extending from opposite directions through the web opening in the through-runner is often referred to as the "second-end-in-lock" or "connector-to-connector" lock. Examples of grid systems having both a first-end-in-lock and a connector-to-connector lock are illustrated in U.S. Pat. Nos. 4,108,563 and 4,611,453 (both assigned to the assignee of the present invention and incorporated herein by reference).

SUMMARY OF THE INVENTION

In accordance with the present invention, a novel and improved suspension ceiling grid connector system reliably provides a secure, strong connection capable of withstanding large separating forces. Such connector is easily assembled in a grid and is easily disassembled without requiring tools of any kind, even in a trapped module location in which the two ends of the runner are longitudinally confined by the remainder of the grid. Such disassembly, even in a trapped module location, does not significantly damage the connector, and such connectors are reusable. It is therefore possible to easily remove and/or replace individual grid members from any location in an assembled grid.

There are a number of aspects to this invention. In accordance with one important aspect of the invention, a suspension ceiling grid system combines a hook-type first-end-in-lock with a connector-to-connector lock to provide a reliable, strong connection.

In accordance with another aspect of this invention, a novel and improved dual-locking system, providing both a hook-type first-end-in-lock and a connector-to-connector lock, is structured so that both locks are engaged by relative movement in the first direction generally aligned with the length of the through-runner opening, and are released by relative movement in the opposite direction.

It is still another aspect of this invention to provide a novel and improved dual-lock suspension ceiling grid system which can be easily and reliably assembled, and which can be disassembled without the use of tools, even from a trapped module condition.

It is still another important aspect of this invention to provide a novel and improved dual-lock grid connector system for suspension ceilings in which full locking is maintained even when opposed connectors are misaligned to a substantial extent.

It is still a further important aspect of this invention to provide an improved connector in which the first-end-in-lock will provide a cantilever support for a runner until the other end of the runner is connected.

These and other aspects of this invention are illustrated in the accompanying drawings, and are more fully described in the following specification.

DETAILED DESCRIPTION OF THE DRAWINGS

Figure 1:
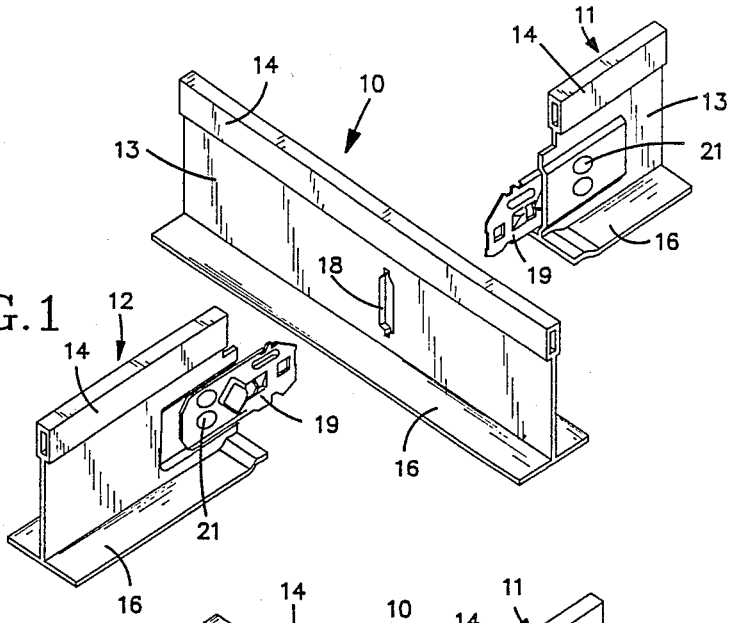
FIG. 1 is a perspective, exploded view of a preferred embodiment of this invention illustrating a through-runner and associated opposed runner ends prior to assembly.
Figure 2:
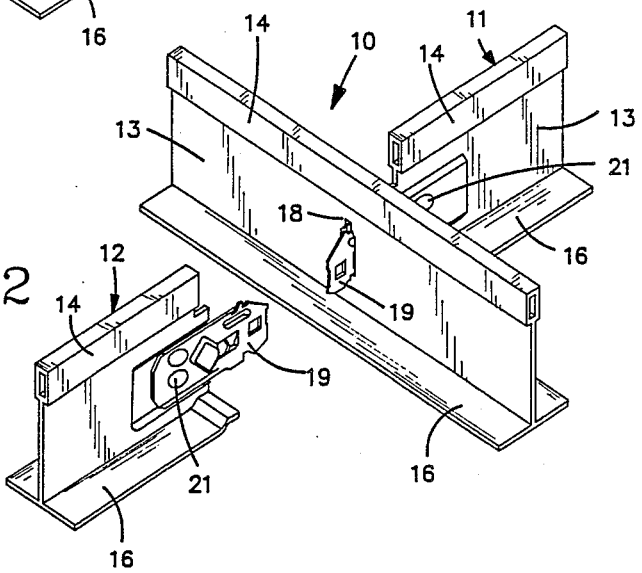
FIG. 2 is similar to FIG. 1, but illustrates the condition which exists after the first end connector is installed in the opening of the through-runner.
Figure 3:
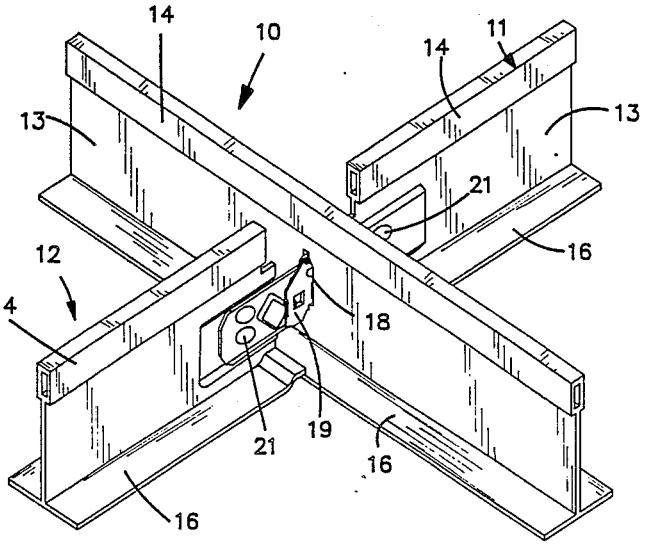
FIG. 3 is similar to FIGS. 1 and 2, but illustrates the condition which exists after both end connectors are installed.

FIGS. 1 through 3 progressively illustrate the assembly of an intersection in a suspension ceiling grid system in accordance with the present invention. Such intersection includes a through-runner 10 and two opposed runner ends 11 and 12. In this illustrated embodiment, all of the runners 10 through 12 are tees formed with a central web 13, a stiffening bulb 14 along one edge of the web 13, and oppositely extending panel supporting flanges 16 along the lower or opposite edge of the web. It should be understood, however, that in accordance with the braoder aspects of this invention, the connecting structure can be applied to other forms of grid tees or runners, and that the particular tee structure is illustrative of one preferred embodiment of this invention. It should further be understood that the grid tees are typically formed of a thin sheet metal which is bent to the cross section illustrated. However, in accordance with the invention, the grid tees can be formed in other ways, e.g., by extrusion or the like, and are not illustrated as bent sheet metal in order to simplify the drawings.

In many grid systems for suspension ceilings, an array of parallel, laterally-spaced through-runners are supported from the building structure above the grid by wires or the like, and cross-tees interconnect with the main runners, with two opposed cross-tee ends positioned on opposite sides of the main runner at each intersection. However, this invention is also applicable to basket-weave-type grid systems in which main runs and cross-runs are not provided, strictly speaking. Both types of grid systems, however, provide intersections in which a through-runner extends past opposed runner ends which interconnect with the through-runner at the intersections. Therefore, as used herein, the term "through-runner" is used instead of "main runners" so as to encompass within the scope of the invention basketweave grid systems, main run and cross-run grid systems, and other types of grid systems which may incorporate the present invention.

Typically the runners of a suspension ceiling grid system are interconnected to form rectangular or square openings bounded by flanges 16. Ceiling panels or fixtures, such as lights and air vents, are then positioned in such openings and are supported around the periphery by the associated of the flanges 16.

Referring specifically to FIGS. 1 through 3, the web 13 of the through-runner 10 is formed with a connector opening 18, and the two runner ends 11 and 12 are provided with identical end connectors 19. In the illustrated embodiment, the connectors 19 are formed of separate elements and are connected to the ends of the webs 13 of the runner ends by a rivet-like connection 21.

FIG. 1 illustrates the runners before either connector is installed in the opening 18. FIG. 2 illustrates the condition after the connector 19 of the first runner end is installed in the opening 18 and is held therein by the first-end-in-lock. FIG. 3 illustrates the completely assembled intersection.

Since the two end connectors 19 are identical, only one will be described in detail, with the understanding that such description applies equally to both end connectors 19.

Figure 4:
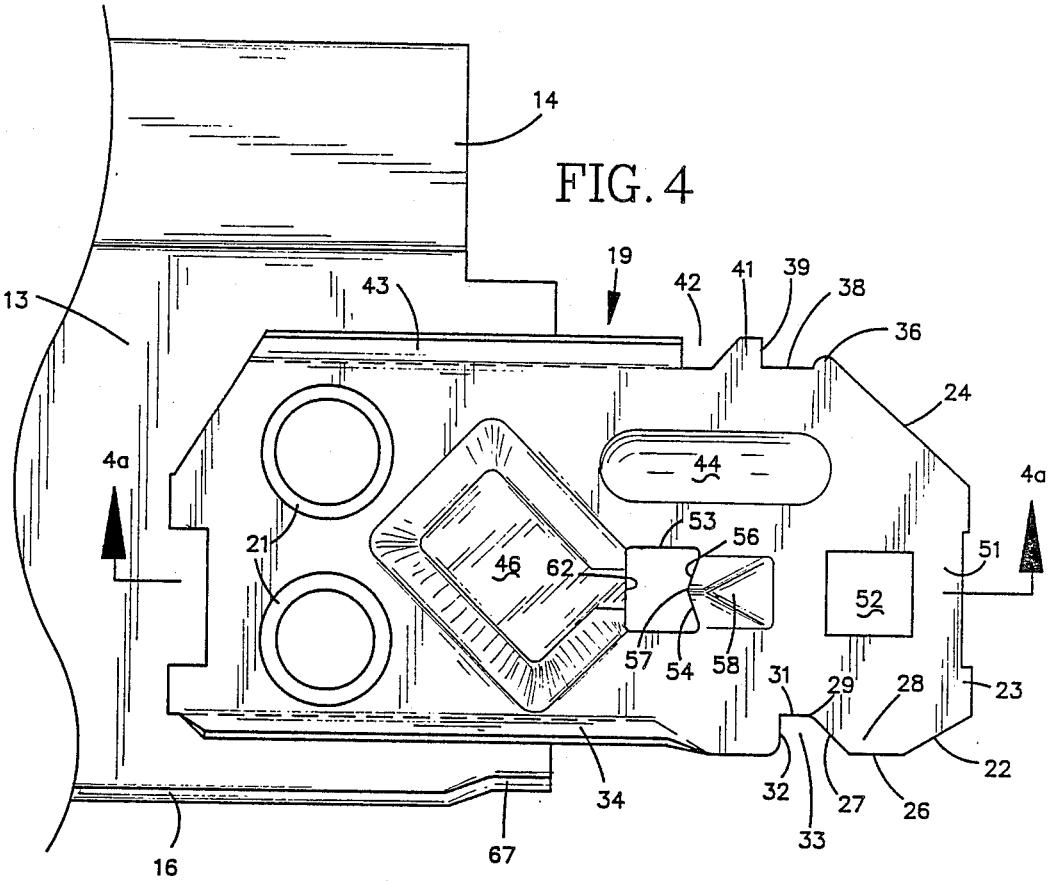
FIG. 4 is an enlarged side elevation of one preferred end connector in accordance with this invention illustrating the structural detail thereof.
Figure 4A:
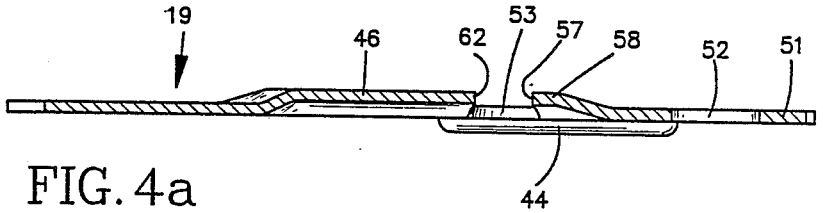
FIG. 4*a* is a longitudinal section taken along line 4*a*—4*a* of FIG. 4.

Referring to FIGS. 4 and 4*a*, each end connector provides a downwardly inclined camming surface 22 extending back from the forward end 23 of the connector along the lower side thereof. The forward end of the connector 19 also provides an upwardly and rearwardly extending camming surface 24, also extending from the forward end 23 of the connector 19. Consequently, the forward end 23 of the connector 19 has a relatively small, vertical height compared to the overall height of the connector and of the connector opening 18. Such structure facilitates the initial entry of the connector into the connector opening 18, as discussed in detail below.

Extending rearwardly from the camming surface 22 is a longitudinally extending edge 26, which extends to an upwardly inclined edge 27. The camming surface 22 and the two edges 26 and 27 cooperate to define a hook-like projection 28 adjacent to the forward end of the connector on the lower side thereof. At the rearward end of the inclined edge 27 a radiused portion 29 blends into a longitudinally extending edge 31, which extends to a shoulder 32. These edge surfaces 27, 29, 31, and 32 cooperate to define an upwardly extending notch 33 rearwardly of the hook-like projection 28. Rearwardly of the notch 33, the lower edge of the connector is angled laterally to provide a stiffening flange 34.

The camming surface 24 extends rearwardly and upwardly, and tangentially intersects a small projection 36 having an edge surface which is a portion of a circle which extends from the camming surface 24 rearwardly to a longitudinal edge 38. The edge 38 extends from the projection 36 rearwardly to an upwardly extending shoulder 39, which forms a part of a stop projection 41. Rearwardly of such projection is a downwardly extending notch 42. Rearwardly of the notch 42, the upper edge of the connector is angled laterally to provide an upper stiffening flange 43.

Additional stiffening is provided by a longitudinally extending boss 44 deformed laterally from the principal plane of the connector and a generally rectangular boss 46 which is positioned at an angle with respect to the length of the connector, and is also formed by deforming the metal of the connector laterally out of the principal plane of the connector. These two stiffening bosses 44 and 46 are positioned so that they overalap in a longitudinal direction a small amount and cooperate to provide the connector with lateral stiffness forwardly from the rivet-like connection 21.

The two projections 28 and 36 cooperate to provide the first-end-in-lock as discussed in detail below. In addition, a second locking system is provided which directly interconnects one connector with the other and provides what is referred to generally as a "connector-to-connector lock." The structure of this locking system includes a lateral strap portion 51 located at the forward end 23 of the connector. The strap is formed by the forward end 23 and a rentangular opening 52 spaced back from the forward end 23 by a distance equal to the width of the strap 51. The other portion of the connector-to-connector lock is provided by a rearward opening 53.

The forward edge of the opening 53 is provided by two angulated edge portions 54 and 56, which are angulated rearwardly and laterally and intersect at the forward center 57 of the opening 53. These edge portions 54 and 56 are inclined laterally from the main plane of the connector by deforming the metal thereof to form a pyramid-like lateral projecting boss 58. This boss 58 is deformed from the principal plane of the connector in a direction opposite the direction of the boss 44.

The rearward edge 62 of the opening is also inclined laterally from the principal plane of the connector in the same direction as the edge portions 54 and 56. In the illustrated embodiment, the edge portion 62 is provided at the forward end of the boss 46, and are deflected laterally when the boss 46 is produced. Such boss, it should be noted, is deflected in an opposite lateral direction from the boss 44.

The intersection 57 and the edge 62 are spaced apart a distance slightly greater than the width of the strap 51, so that when two connectors are installed through an opening 18 from opposite sides of a through-runner, the strap of each connector is positioned within the opening 53 of the other connector. In such position, because the intersection 57 and the edge 62 are laterally displaced from the plane of the connector, the forward and rearward edges of each lateral strap are in alignment with the adjacent pair of inclined edge portions 54 and 56 or the edge 62. Therefore, the strap of each connector provides a connector-to-connector lock which resists relative longitudinal movement between the two connectors installed within a given connector opening 18. The forward opening 52 is positioned and sized so as to accept the pyramid-like boss 58 of the other connector when two connectors are interconnected.

Figure 5:
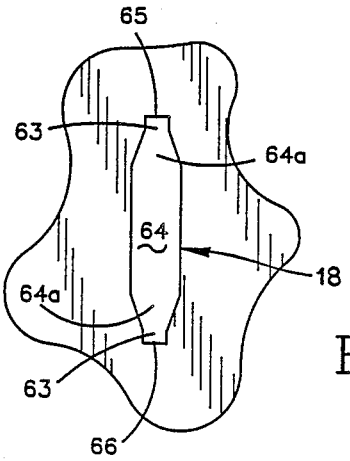
FIG. 5 is a fragmentary view illustrating the shape of the opening in the through-runner.

As best illustrated in FIG. 5, the connector opening 18 formed in the web of the through-runner 10 is vertically elongated and symmetrical about a central vertical plane. The opening 18 includes a narrow portion 63 extending downwardly from the upper edge 65 and a similar narrow portion 63 extending upwardly from the lower edge 66 of the opening. Such narrow portions 63 have a width sized to closely fit two end connectors 19 extending therethrough. Between the narrow portion 63, the opening provides a central portion 64 of greater width, and which is joined to the narrow portions 63 by tapered transition portions 64a. The width of the central portion is sized to receive the forward ends of the bosses 44 of the two connectors with a close fit.

Figure 6:
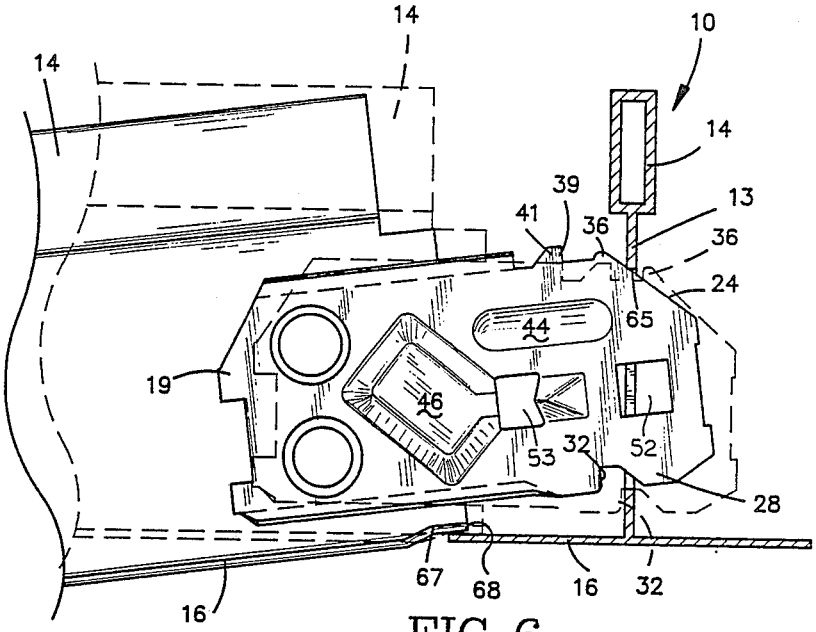
FIG. 6 is a side elevation illustrating one of the connectors in intermediate positions through which it moves during normal assembly and disassembly.

Reference should now be made to FIG. 6, which illustrates the manner in which a connector 19 is normally installed in a connector opening 18 of a through-runner 10. Initially, the connector 19 is moved longitudinally into the opening 18 at an angle, as illustrated in full-line in FIG. 6. This is easily accomplished since one or the other of the camming surfaces 21 or 24 will engage the adjacent end of the opening and guide the connector as it is moved into the opening. Such longitudinal movement is, therefore, very easily accomplished, and it is not necessary to precisely position the connector to start it into the associated opening.

The longitudinal movement of the connector continues until the hook-like projection 28 passes the lower edge 66 of the opening 18. As the connector is moved forward toward the phantom position, the upper camming surface 24 engages the upper edge 65 of the opening 18 and cams the connector down until the forward end 67 of the flange 16 of the associated runner end 12 engages the top surfaces 68 of the flange 16 of the through-runner. It should be noted from the full-line position that the two flanges engage before the upper projection 36 passes throgh the opening, and the dimensions are such that the upper projection 36 extends above the upper edge 65 of the opening 18. From the full-line position of FIG. 6, the runner end is tipped upwardly toward the horizontal position while being pressed forward. This causes the inclined edge 27 to move down along the lower edge 66 of the opening and the upper camming surface to move down and forward along the upper edge 65 of the opening 18.

The end connector, however, is sized so that as the runner end approaches the horizontal position, the upper surface 68 of the flange continues to attempt to hold the upper projection 36 above the upper edge 65 of the opening 18.

The projection 36, however, is rounded so that it functions to cam the connector downwardly when the associated runner is tipped up to a horizontal position, causing a temporary deflection of the flange 16 of the through-runner. Therefore, the projection 36 snaps through the opening 18 of the through-runner and after passage through the opening, the engagement between the flanges 16 raises the connector up slightly so that the upper edge 65 of the opening is below the upper extremity of the projection 36. The notch 33 is sized to allow such temporary downward movement, permitting the upper projection to snap through the opening.

When the connector reaches the phantom position of FIG. 6, the first-end-in-lock is completed and the projection 36 cooperates with the inclined edge 27 to engage the remote side of the web of the through-runner to lock the connector in position. In fact, when the first-end-in-lock in completed, a sufficient locking force is provided to allow the first installed runner end to be cantileversupported on the through-runner. This is an important feature of the invention, since the connection will support the runner temporarily in a cantilever fashion if the installer releases his grip on the runner preparatory to installing the other end connector at the opposite end of the runner involved. It also functions to ensure that the through-runner is restrained against twisting movement even if only one connector is installed in a given opening.

For example, if the through-runner tends to twist or rotate in an anticlockwise direction, its web engages the shoulder 39 at the upper end of the opening and the upwardly inclined edge 27 at the lower edge of the opening to resist such twisting movement. Similarly, clockwise twisting or rotation of the through-runner is resisted by engagement between the projection 36 and the upper edge of the opening 18 while engagement between the shoulder 32 and the lower edge of the opening occurs.

Removal of a single connector from an installed position is accomplished easily by merely pressing down on the runner end 12 to again temporarily deflect the flange of the through-runner so as to clear the upper projection 36 while moving the runner to a downwardly angled position so that the upper projection 36 moves back through the opening. Once this has occurred, the runner can be pulled longitudinally out of the opening and is cammed upwardly to clear the opening by engagement between the inclined edge 27 and the lower edge 66 of the opening 18.

Figure 7:
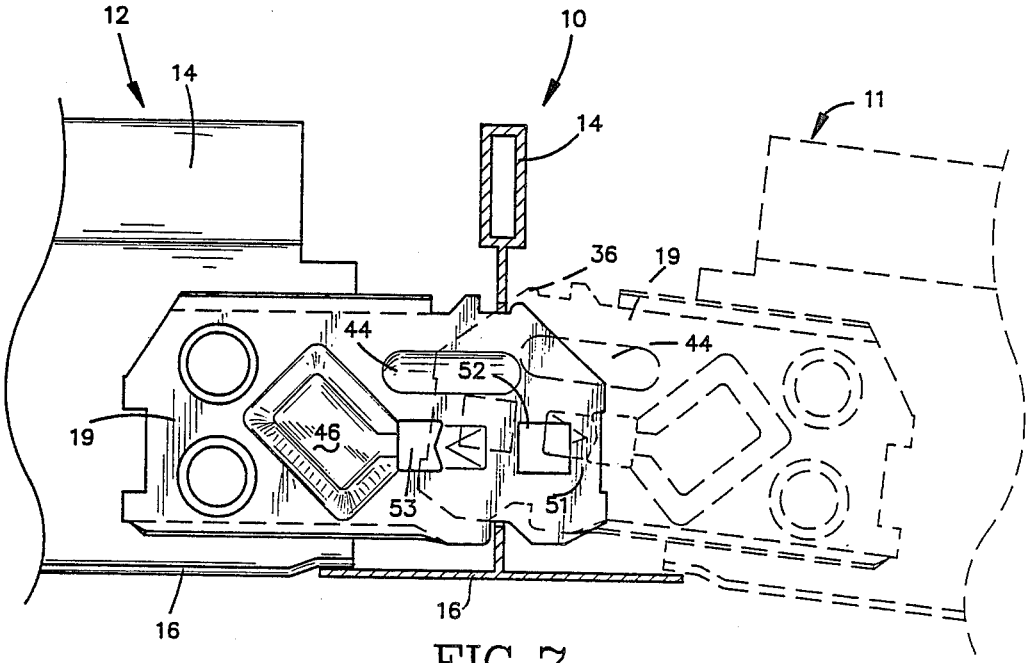
FIG. 7 is a side elevation illustrating the installation of the second connector in the opening in the through-runner.
Figure 8:
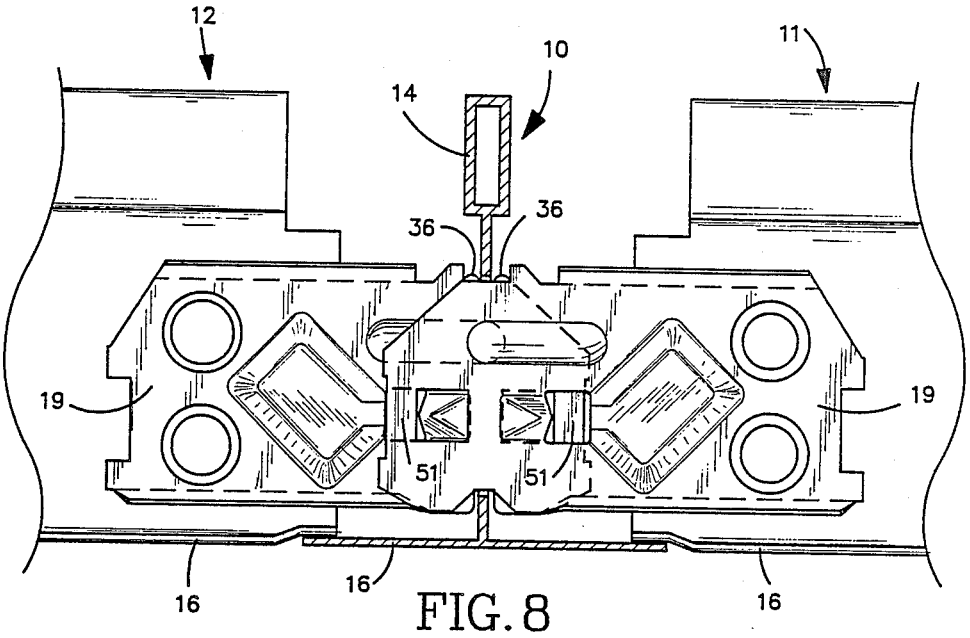
FIG. 8 is a side elevation of an intersection illustrating the two connectors in their installed position.

After the first end connector is installed in a given opening, the second end connector is inserted from the opposite side through the opening in the same manner as illustrated in FIG. 7, causing the projection 36 of the second connector to snap through the opening to a fully installed position as illustrated in FIG. 8. In such position, the lateral strap 51 of each connector 19 is positioned within the opening 53 of the other connector and a connector-to-connector connection is provided on each side of the web of the through-runner. When the two connectors are installed, the forward ends of the bosses 44 engage the side of the opening to ensure that the two connectors are held in face-to-face contact. This ensures that the connector-to-connector locks engage.

Figure 9:
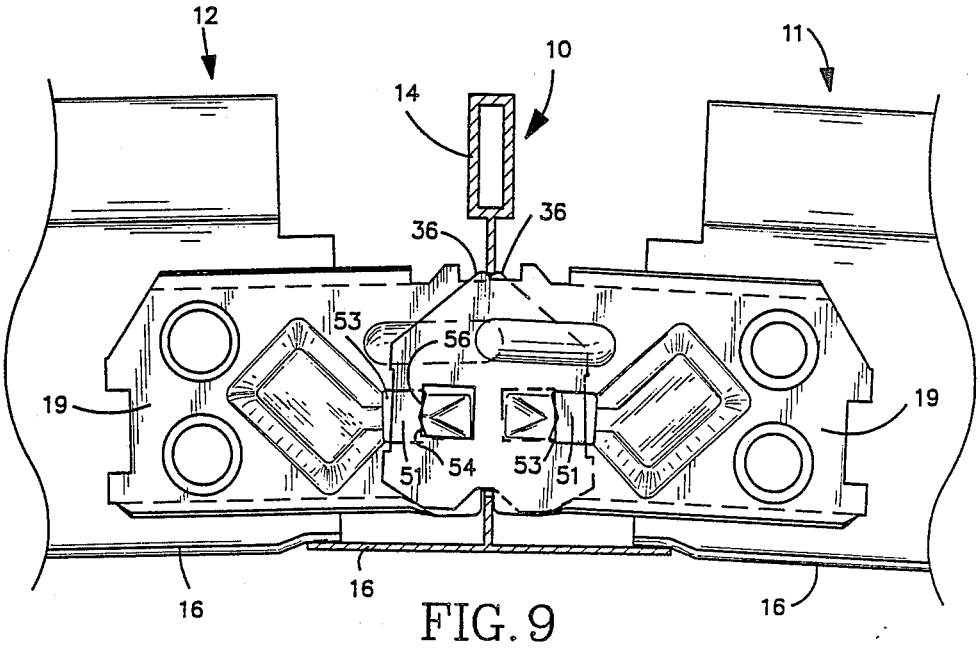
FIG. 9 is a side elevation similar to FIG. 8, but illustrating how the connectors can accommodate an out-of-alignment condition.

When the two connectors are installed, sufficient clearance is provided to allow the two runner ends 11 and 12 to be inclined slightly relative to each other, so that a strong connection is provided even when the runner ends are not in direct alignment, as best illustrated in FIG. 9. Further, because the edges of the opening 53 provided by the edge portions 54 and 56 are inclined, clearance is provided to allow such misalignment without affecting the connector-to-connector lock formed with the associated of the straps 51.

In accordance with this invention, a runner can be removed or replaced at any location within a grid without difficulty and without the use of special tools. This is true even if the runner is in a trapped module condition in which the two ends of the runner involved are held by the surrounding grid members against longitudinal movement in both directions. When disassembling an intersection from a nontrapped module condition, in which the remote end of the runner is free to be moved laterally and longitudinally, a downward force is applied to the runner end to temporarily deflect the flange 16 of the through-runner 10. This moves the projection 36 down clear of the upper edge 65 of the opening 18. Simultaneously, the runner is tipped down to move the projection back out of the opening. Thereafter, the connector 19 is raised up out of the opening to complete disassembly. Because the edges 54 and 56 of the opening 53 are inclined back, such movement of the connector 19 being removed to an inclined position is accommodated. Further, the upward removal is also accommodated. In effect, the connector-to-connector lock is established and/or released by relative vertical movement of the connectors generally in a direction aligned with the length of the opening.

During installation, the forward end of the connector is cammed downwardly by the camming surface 24, and such movement causes the inclined surface 27 to cam the connector forwardly. Consequently, the nnector moves in an inclined direction which is generally aligned with the length of the opening 18 and, during such movement, the connector-to-connector lock engages. During removal, the opposite movement occurs and the connector moves along an inclined upward and rearward path again generally aligned with the length of the opening 18. Because the engaging edges of the connector-to-connector lock are also inclined, the connector-to-connector lock allows such movement and is released.

Figure 10:
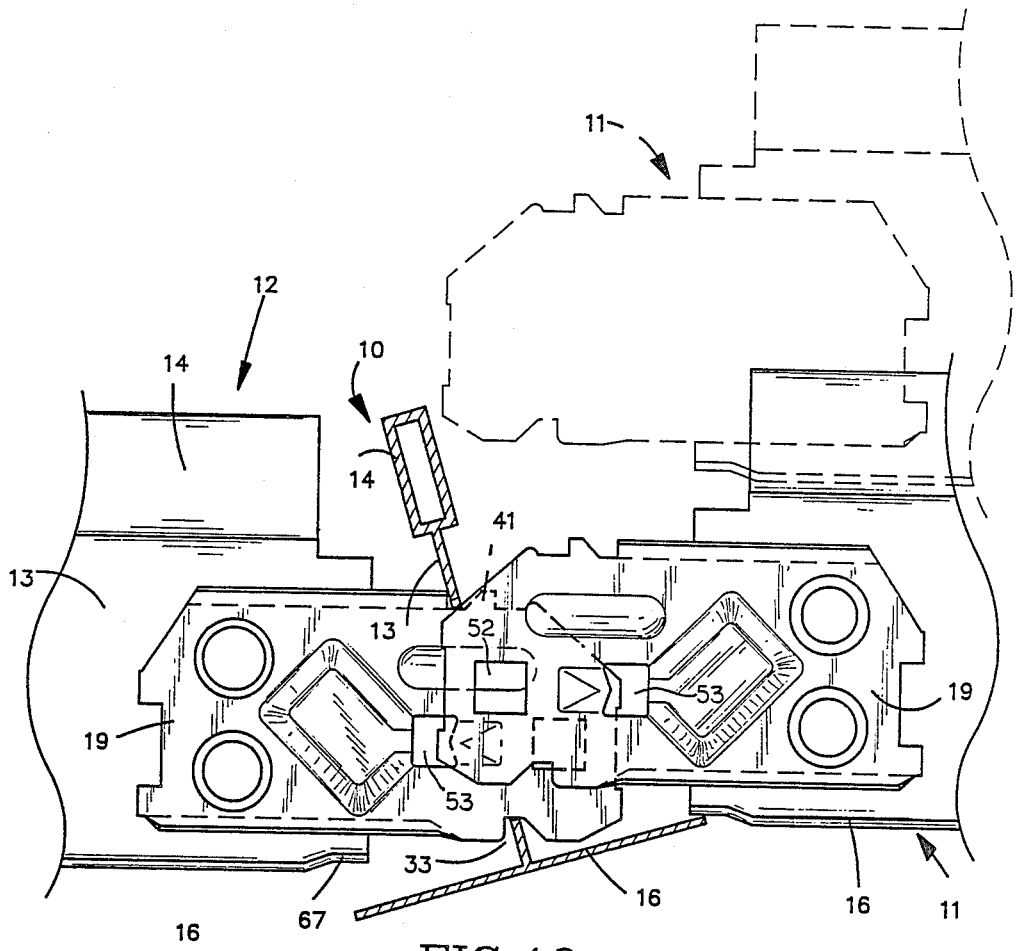
FIG. 10 illustrates, in full-line, the first operation of disassembly from a trapped module condition and, in phantom, completed disassembly by vertical movement.

The removal from the trapped module condition can be accomplished in either of two ways. FIG. 10 illustrates in full-line the first step in the removal of a runner 11 from a trapped module condition. The first step in such removal is performed by grasping and through-runner on each side of the intersection and rotating the upper part of the through-runner 10 in a direction away from the runner 11 which is to be removed. Such rotation can be accomplished easily with the hand, but does require some force since it is necessary that the web of the through-runner at the upper end of the opening 18 move past the projections 36 and 41.

In accordance with the preferred embodiment, the connectors are made of steel or the like which is strong and quite hard. On the other hand, the runners themselves are formed of a common quality cold-rolled steel which is not as hard. Therefore, when the through-runner is rotated to the full-line position of FIG. 10, the projection 41 of the connector which is not being removed cuts through the web immediately above the opening 18. Although this cutting action does permanently produce a narrow cut in the web of the through-runner above the opening 18, it does not interfere to any material extent with the future reinstallation of a pair of connectors in the opening.

As the through-runner is rotated to the full-line position, the flange of the through-runner 10, through its engagement with the flange of the runner end 11, causes the runner end 11 to raise up relative to the runner end 12. This vertical relative movement causes the straps 51 to move vertically out of the associated opening 53 and disconnects the connector-to-connector lock provided by such straps. Further, the upper edge 65 of the opening 18 moves down along the inclined camming surface 24.

As soon as the through-runner has been rotated to the full-line position, complete removal of the connector 19 of the runner end 11 can be accomplished in either of two ways. The first and usual removal involves the upward movement of the runner end 11. It is recognized that some interference does exist, but sufficient flexibility exists in the system to allow the connector end 19 of the runner 11 to move upwardly and be cammed by the cam surface 24 clear of the opening. Once one end of the runner 11 is disconnected, the runner is no longer in a trapped module condition and the other end can be disconnected in the usual way.

Figure 11:
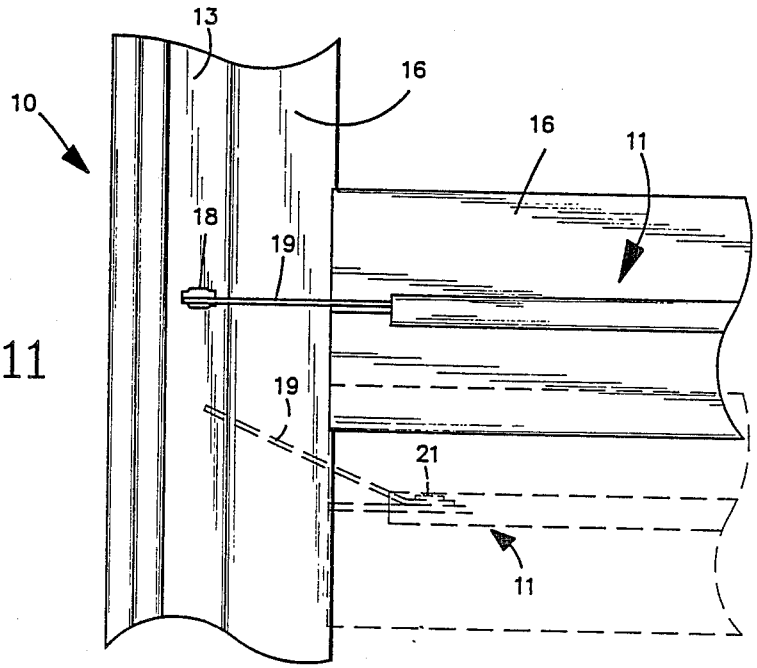
FIG. 11 is a plan view illustrating completed disassembly by horizontal movement.

In instances in which the ceiling structure is so close to the grid as to prevent vertically upward movement during the removal of the runner end 11, the removal can be performed in a horizontal direction by merely driving the runner horizontally in a direction aligned with the length of the through-runner and away from the connector 19 of the runner end 12, as illustrated in FIG. 11. Here again, because some interference exists, such horizontal movement results in some bending of the connector adjacent to the rivet connection, as illustrated in FIG. 11.

With either type of removal of the trapped module connector, there is no material damage to the connector or the opening, and the same connector can be reinstalled in the opening if desired. If vertical disassembly has been used, reinstallation is accomplished by bringing the connector down into the fullline position. Again, the interference is accommodated during such movement by applying force on the through-runner in one direction and on the runner end 11 in the opposite longitudinal direction, which causes sufficient temporary deformation of the two runners 11 and 12 to cause the camming surface 22 to guide the connector 19 for re-entry into the opening 18. Completion of the reinstallation is then accomplished by rotating the through-runner back to its vertical position. This causes the straps 51 to move back into the associated openings 53 and re-establishes the connector-to-connector lock. Because no significant damage occurs to the openings or the straps, a full strength connection is re-established.

In instances in which the connector has been removed by horizontal movement rather than vertical movement, reassembly is accomplished by moving the connector along the length of the web of the through-runner back to the opening 18 in the through-runner. The connector is then bent back to a straight condition so that the through-runner can be rotated back to its vertical position to cause the connector-to-connector lock to be re-established.

In practice, it is often desirable to bend the connector 19 of the runner end 11 a slight additional amount so that the end of the connector 19 will not dig into the web as the connector is moved into the opening 18.

Here again, because the bend occurred adjacent to the rivet, the locking portion of the connector is not distorted and the connector-to-connector lock is re-established.

In both procedures for releasing a connector from a trapped module condition, the rotation of the through-runner from its vertical position to the angled position illustrated in FIG. 10 causes vertical movement of one connector relative to the other, and such vertical movement in a direction generally aligned with the opening causes release of the connector-to-connector lock so that full removal of the connector can be easily achieved. Conversely, during re-installation or reconnection, the rotation of the through-runner 10 back to the vertical position causes relative vertical movement between the connectors in a direction generally aligned with the length of the opening 18, and re-establishes the connector-to-connector lock.

With the present invention, a simple connector structure is provided for suspension ceiling grid systems providing for easy assembly of the grid. Further, a very strong connection is provided capable of meeting all standards for strength because a dual connector-to-connector lock is provided. Further, a very stable first-end-in connection provides stability to an intersection even when two connectors are not installed within the same opening.

Although the preferred embodiment of this invention has been shown and described, it should be understood that various modifications and rearrangements of the parts may be resorted to without departing from the scope of the invention as disclosed and claimed herein.

What is claimed is:

1. A suspension ceiling grid system comprising elongated grid runners interconnected at intersections, including a through-runner and two opposed runner ends said runners including a web, an elongated verticaly extending opening in the web of said through-runner having an upper and a lower end, and generally planar end connectors on the ends of said opposed runners projecting into said opening from opposite sides thereof, each connector providing lateral projections engaging the remote side of said through-runner web beyond said upper and lower ends thereof to provide a first-end-in-lock with said through-runner.

2. A suspension ceiling grid system as set forth in claim 1, wherein said grid also includes at least one intersection in which only one end connector is positioned within a through-runner opening, said first-end-in-lock being engageable with both sides of said through-runner web beyond both ends of said through-runner opening to resist tipping of said through-runner, said first-end-in-lock being operable to cantilever support the associated runner.

3. A suspension ceiling grid system as set forth in claim 1, wherein said runners provide flanges along one edge of said web, said flanges of said opposed runners engaging one side of said flange of said through-runner and normally maintaining one of said lateral projections in alignment with said remote side of said through-runner web beyond the adjacent end of said opening, said flanges of said throughrunner being temporarily deflectable to permit passage of said one lateral projection through said opening.

4. A suspension ceiling grid system as set forth in claim 3, wherein said end connectors provide connector-to-connector locks on each side of said through-runner web.

5. A suspension ceiling grid system as set forth in claim 4, wherein said connector-to-connector locks are engageable and releasable by relative movement therebetween in directions generally aligned with the length of said opening.

6. A suspension ceiling grid system as set forth in claim 5, wherein said end connectors each provide lateral projections engageable with both sides of said through-runner web beyond both ends of said through-runner opening normally preventing said through-runner from rotating about its longitudinal length, said runner providing means for disassembly allowing rotation of said through-runner about its length past some of said projections causing said connector ends to move relative to each other to release said connector-to-connector lock and permit removal of one end connector from a trapped module condition.

7. A suspension ceiling grid system as set forth in claim 6, wherein said one end connector is removable from said trapped module condition by movement generally aligned with the length of said opening.

8. A suspension ceiling grid system as set forth in claim 6, wherein said one end connector is removable from said trapped module condition by movement lengthwise of said through-runner.

9. A suspension ceiling grid system as set forth in claim 8, wherein said one end connector is removable from a trapped module condition by movement either aligned with the length of said opening or lengthwise of said through-runner.

10. A suspension ceiling grid system as set forth in claim 8, wherein said end connectors provide lateral boss means to stiffen said end connectors and prevent substantial bending of the forward portion thereof when removed by said movement thereof lengthwise of said through-runner.

11. A suspension ceiling grid system comprising elongated grid runners interconnected at intersections including a through-runner and two opposed runner ends connected together on opposite sides of said through-runner, said runners including a web, an elongated vertically extending opening in the web of said through-runner having an upper end extremity and a lower end extremity, generally planar end connectors on the ends of said opposed runners projecting into said opening from opposite sides thereof, said connectors providing first lock means each operable to project through said opening and move lengthwise of said opening between a release position and a locked position in which said first lock means engages the remote side of said web beyond one end extremity of said opening, said connectors also providing connector-to-connector locking means directly interconnecting said connectors by relative movement between said connectors in a direction lengthwise of said opening and preventing relative longitudinal movement of said opposed runners in a direction away from each other.

12. A suspension ceiling grid system as set forth in claim 11, wherein said connectors provide an opposed surface engaging the other extremity of said opening normally preventing said lateral movement of said connectors with respect to said through-runner to prevent release of said locking means.

13. A suspension ceiling grid system as set forth in claim 12, wherein said connector remains locked when said connectors are misaligned a small amount.

14. A suspension ceiling grid system as set forth in claim 12, wherein said connector-to-connector lock means provdes a lock on each side of side through-runner.

15. A suspension ceiling grid system as set forth in claim 14, wherein said first lock means provides a hook-like projection engaging the remote side of said through-runner web.

16. A suspension ceiling grid system as set forth in claim 12, wherein said through-runner and connectors permit tipping of the through-runner with respect to said connectors to clear said opposed surfaces of one of said connectors and permitting said lateral movement of said one connector to release said locking means.

17. A suspension ceiling grid system as set forth in claim 16, wherein said grid provides some runners in a trapped module condition, said connectors of said some runners being removable from said trapped module condition without sufficient damage to the associated of said openings or the associated of said connectors to prevent reinstallation thereof.

18. A suspension ceiling grid system as set forth in claim 17, wherein said runner provide opposed panel supporting flanges along one edge of said web.

19. Elongated runners for suspension ceiling grid systems adapted to be interconnected at intersections including a through-runner and opposed runner ends connected to said through-runner on opposite sides thereof comprising through-runners providing a web having an elongated vertically extending opening therethrough having an upper end extremity and a lower end extremity, opposed runners providing generally planar connectors at their ends adapted to extend through said opening, said connectors providing first lock means including a projection along one edge thereof adapted to be positioned in alignment with the remote side of said through-runner web beyond one extremity of said opening, said connectors also providing second lock means adapted to interconnect two connectors extending through said opening on both sides of said opening by relative movement between said connector lengthwise of said opening.

20. Elongated runners as set forth in claim 19, wherein said second lock means include spaced rearwardly facing surfaces, said rearwardly facing surfaces on each connector being engageable with a rearwardly facing surface on an said other extending through said opening to prevent separating movement of said associated connectors.

21. Elongated runners as set forth in claim 20, wherein at least one of said rearwardly facing surfaces is inclined to permit misalignment of said connectors without releaing said second locking means.

22. Elongated runners as set forth in claim 20, wherein said first and second locking means are interconnected by movement in one direction generally aligned with the length of said opening and release the movement in the second direction opposite said one direction.

23. Elongated runners as set forth in claim 22, wherein said rearwardly facing surafces are provided by straps adjacent to the ends of said connectors, and said forwardly facing surfaces are provided at a location spaced back from said ends of said connectors.

24. Elongated runners as set forth in claim 23, wherein said connectors provide an aperture adjacent one of said rearwardly facing surfaces sized to receive said strap of an associated connector.

25. Elongated runners as set forth in claim 22, wherein said connectors provide opposed edges normally engageable with the opposite extremity of said opening to prevent movement in said second direction, said opposed edge being movable clear of said opposite extremity by relative tipping between said through-runner and the associated runner end.

26. An end connector for a suspension ceiling grid system adapted to be connected through an elongated opening in the web of a perpendicularly extending through-runner, comprising an elongated body extending to a forward end, opposed diverging camming surfaces extending rearwardly from said forward end to oppositely extending lateral projections, a pair of inwardly extending notches adjacent to said projections and rearwardly thereof, and an outwardly extending shoulder along the rearward side of said notches, said projections and shoulders being aligned with opposite sides of said web beyond the edge of said opening when said connector extends through said opening, said end connector also providing a lateral strap portion adjacent to said outer end and opposed locking edges spaced back from said forward end, said lateral strap and opposed locking edges being sized and positioned to interfit with said locking edges and lateral strap of an identical end connector extending through said opening from the opposite side thereof to provide a connector-to-connector lock on each side of said opening.

* * * * *

UNITED STATES PATENT AND TRADEMARK OFFICE

CERTIFICATE OF CORRECTION

PATENT NO. : 4,779,394

DATED : October 25, 1988

INVENTOR(S) : Richard Shirey, et al.

It is certified that error appears in the above-identified patent and that said Letters Patent is hereby corrected as shown below:

Col. 4, line 49 "rentangular" should be --rectangular--.

Col. 6, line 20 "in" should be --is--.

Col. 6, line 22 "cantileversupported" should be --cantilever-supported--.

Col. 7, line 51 "and" should be --the--.

Col. 9, line 37 "verticaly" should be --vertically--.

Col. 9, line 62 "throughrunner" should be --through-runner--.

Col. 11, line 1 "provdes" should be --provides--.

Col. 11, line 1 "side" (second occurrence) should be --said--.

Col. 11, line 21 "runner" should be --runners--.

Col. 11, line 46 "an" should be omitted.

UNITED STATES PATENT AND TRADEMARK OFFICE

CERTIFICATE OF CORRECTION

PATENT NO. : 4,779,394

DATED : October 25, 1988

INVENTOR(S) : Richard Shirey, et al.

It is certified that error appears in the above-identified patent and that said Letters Patent is hereby corrected as shown below:

Col. 11, line 46 "connector" should be inserted between --other-- and --extending--.

Signed and Sealed this

Fourth Day of April, 1989

*Attest:*

*Attesting Officer*

DONALD J. QUIGG

*Commissioner of Patents and Trademarks*

US004779394B1

REEXAMINATION CERTIFICATE (2403rd)

United States Patent [19]

[11] B1 4,779,394

Shirey et al.

[45] Certificate Issued Sep. 27, 1994

[54] CONNECTOR FOR SUSPENSION CEILING GRID

[75] Inventors: Richard Shirey, Avon; Gerald L. Koski, Parma; Jonathan P. Teli, Avon Lake; David F. Mieyal, Strongsville, all of Ohio

[73] Assignee: Donn Incorporated, Chicago, Ill.

Reexamination Request:
No. 90/002,225, Dec. 11, 1990

Reexamination Certificate for:

| | |
|---|---|
| Patent No.: | **4,779,394** |
| Issued: | **Oct. 25, 1988** |
| Appl. No.: | **38,246** |
| Filed: | **Apr. 14, 1987** |

Certificate of Correction issued Apr. 4, 1989.

[51] Int. Cl.[5] ..... E04C 2/42
[52] U.S. Cl. ..... 52/667; 52/506.07
[58] Field of Search ..... 52/667, 664, 484

[56] References Cited

U.S. PATENT DOCUMENTS

| | | | |
|---|---|---|---|
| 3,367,695 | 2/1968 | Haertel et al. . | |
| 3,501,185 | 3/1970 | Brown et al. . | |
| 4,108,563 | 8/1978 | Brown et al. . | |
| 4,317,641 | 3/1982 | Sauer . | |
| 4,494,350 | 1/1985 | Sharp | 52/484 X |
| 4,499,697 | 2/1985 | LaLonde | 52/484 X |
| 4,505,083 | 3/1985 | Mieyal | 52/484 X |
| 4,525,973 | 7/1985 | Vukmanic et al. | 52/484 X |
| 4,611,453 | 9/1986 | Worley . | |

*Primary Examiner*—Lanna Mai

[57] ABSTRACT

A suspension ceiling grid system having grid runners connected at intersections including a through-runner and opposed runner ends connected together and to the through-runner on opposite sides of the through-runner. Each runner end is provided with an end connector which extends through an opening in the web of the through-runner. Each connector is provided with a first-end-in-lock which connects the connector to the through-runner itself and a dual connector-to-connector lock which interconnects the two connectors at the intersection. The first-end-in-lock provides opposed lateral projections which engage the remote side of the web of the through-runner beyond the ends of the opening therein. The connectors may be diassembled from an intersection without the need for tools and without damage to either the connector or the through-runner opening. Further, an intersection can be disassembled and subsequently reassembled in a trapped module condition.

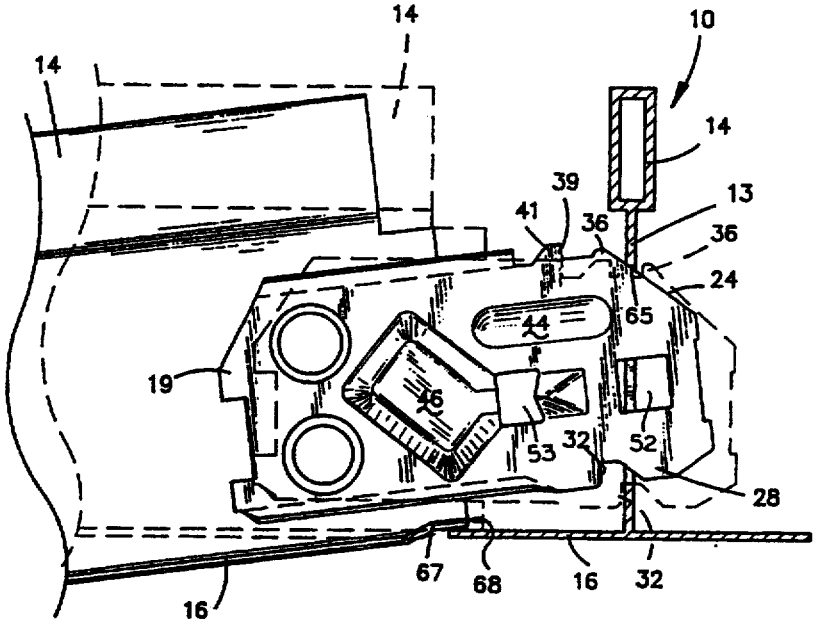

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, lines 52–66:

After the first end connector is installed in a given opening, the second end connector is inserted from the opposite side through the opening in the same manner as illustrated in FIG. 7, causing the projection 36 of the second connector to snap through the opening to a fully installed position as illustrated in FIG. 8. In such position, the lateral strap 51 of each connector 19 is positioned within the opening 53 of the other connector and a connector-to-connector connection is provided on each side of the web of the through-runner. When the two connectors are installed, the forward ends of the bosses 44 engage the side of the opening to ensure that the two connectors are held in face-to-face contact. This ensures that the connector-to-connector locks engage. *The connector-to-connector lock includes two rearwardly facing surfaces on each of the connectors. The first rearwardly facing surface on each connector is provided by the edge portions 54 and 56, while the second rearwardly facing surface is provided by the rearward edge of the strap 51.*

AS A RESULT OF REEXAMINATION, IT HAS BEEN DETERMINED THAT:

Claims 1, 4 and 5 are cancelled.

Claims 2, 3, 6, 11, 12, 14, 15, 18–21, 23 and 26 are determined to be patentable as amended.

Claims 7–10, 13, 16, 17, 22, 24 and 25, dependent on an amended claim, are determined to be patentable.

2. A suspension ceiling grid system as set forth in claim [1] *11*, wherein said grid also includes at least one intersection in which only one end connector is positioned within a through-runner opening, said first-end-in-lock being engageable with both sides of said through-runner web beyond both [ends] *end extremities* of said through-runner opening to resist tipping of said through-runner, said first-end-in-lock being operable to cantilever support the associated runner.

3. A suspension ceiling grid system as set forth in claim [1] *19*, wherein *each of* said runners provide [flanges] *a flange* along one edge of said web, said flanges of said opposed runners engaging [one] *an adjacent* side of said flange of said through-runner and normally maintaining one of said lateral projections in alignment with said remote side of said through-runner web beyond the [adjacent] end *extremity* of said opening *adjacent to said one lateral projection*, said [flanges] *flange* of said [throughrunner] *through-runner* being temporarily deflectable to permit passage of said one lateral projection through said opening.

6. A suspension ceiling grid system as set forth in claim [5] *19*, wherein said end connectors each provide lateral projections engageable with both sides of said through-runner web beyond both ends of said through-runner opening normally preventing said through-runner from rotating about its longitudinal length, said runner providing means for diassembly allowing rotation of said through-runner about its length past some of said projections causing said connector ends to move relative to each other to release said connector-to-connector lock and permit removal of one end connector from a trapped module condition.

11. A suspension ceiling grid system comprising elongated grid runners interconnected at intersections including a through-runner and two opposed runner ends connected together on opposite sides of said through-runner, said runners including a web, an elongated vertically extending opening in the web of said through-runner having an upper end extremity and a lower end extremity, *said through-runner web providing two remote sides, one of said two opposed runner ends being associated with one of said two remote sides, the other of said two opposed runner ends being associated with the other of said two remote sides*, generally planar end connectors on the ends of said opposed runners projecting into said opening from opposite sides thereof, said connectors providing first lock means each operable to project through said opening and move lengthwise of said opening between a release position and a locked position in which said first lock means [engages the remote side of said web] *provides a lateral projection extending* beyond one end extremity of said opening *along the associated remote side of said through-runner web for engagement therewith, each runner providing a flange along one edge of said web, said flange of each of said opposed runner ends engaging an adjacent side of said flange of said through-runner, said flange of said through-runner normally maintaining said lateral projection beyond said one end extremity of said opening along the associated remote side of said through-runner web, said flange of said through-runner being temporarily deflectable to permit passage of said projection through said through-runner opening*, said connectors also providing connector-to-connector locking means directly interconnecting said connectors by relative movement between said connectors in a direction lengthwise of said opening and preventing relative longitudinal movement of said opposed runners in a direction away from each other.

12. A suspension ceiling grid system as set forth in claim 11, wherein said connectors provide an opposed surface [engaging] *engageable with* the other extremity of said opening normally preventing said lateral movement of said connectors with respect to said through-runner to prevent release of said locking means.

14. A suspension ceiling grid system as set forth in claim 12, wherein said connector-to-connector lock means [provdes] *provides* a lock on each side of [side] *said* through-runner.

15. A suspension ceiling grid system as set forth in claim 14, wherein said first lock means provides a hook-like projection [engaging] *engageable with* the remote side of said through-runner web.

18. A suspension ceiling grid system as set forth in claim 17, wherein said [runner] *runners* provide opposed panel supporting flanges along one edge of said web.

19. Elongated runners for suspension ceiling grid systems adapted to be interconnected at intersections including a through-runner and opposed runner ends connected to said through-runner on opposite sides thereof comprising through-runners providing a web having an elongated vertically extending opening therethrough having an upper end extremity and a lower end extremity, *said web of said through-runner having two remote sides, one of said opposed runner ends being associated with one of said two remote sides, the other of said opposed runner ends being associated with the other of said two remote sides,* opposed runners providing generally planar connectors at their ends adapted to extend through said opening, said connectors providing first lock means including [a projection along one edge thereof] *an upper lateral projection along an upper edge thereof* adapted to be positioned in alignment with the *associated* remote side of said through-runner web beyond [one] *said upper end* extremity of said opening, *said first lock means also including a lower lateral projection along the lower edge of said connectors adapted to be positioned in alignment with the associated remote side of said through-runner web beyond the lower end extremity of said opening,* said connectors also providing second lock means adapted to interconnect two connectors extending through said opening on both sides of said opening by relative movement between said [connector] *connectors* lengthwise of said opening.

20. Elongated runners as set forth in claim 19, wherein said second lock means include spaced rearwardly facing surfaces, said rearwardly facing surfaces on each connector being engageable with a rearwardly facing surface on [an] said other *connector* extending through said opening to prevent separating movement of said associated connectors.

21. Elongated runners as set forth in claim 20, wherein at least one of said rearwardly facing surfaces is inclined to permit misalignment of said connectors without [releaing] *releasing* said second locking means.

23. Elongated runners as set forth in claim 22, wherein said rearwardly facing surafces are provided by straps adjacent to the ends of said connectors, and [said] forwardly facing surfaces are provided at a location spaced back from said ends of said connectors.

26. An end connector for a suspension ceiling grid system adapted to be connected through an elongated opening in the web of a perpendicularly extending through-runner *having an upper end extremity and a lower end extremity,* comprising an elongated body extending to a forward end, opposed diverging camming surfaces extending rearwardly from said forward end to oppositely extending lateral projections, a pair of inwardly extending notches adjacent to said projections and rearwardly thereof, and an outwardly extending shoulder along the rearward side of said notches, said projections and shoulders being aligned with opposite sides of said web beyond [the edge] *both end extremities* of said opening when said connector extends through said opening, said end connector also providing a lateral strap portion adjacent to said outer end and opposed locking edges spaced back from said forward end, said lateral strap and opposed locking edges being sized and positioned to interfit with said locking edges and lateral strap of an identical end connector extending through said opening from the opposite side thereof to provide a connector-to-connector lock on each side of said opening.

* * * * *